US010932021B2

(12) United States Patent
Yin et al.

(10) Patent No.: US 10,932,021 B2
(45) Date of Patent: Feb. 23, 2021

(54) SPEAKER BOX AND MOBILE TERMINAL DEVICE USING SAME

(71) Applicant: AAC Technologies Pte. Ltd., Singapore (SG)

(72) Inventors: Zhaoyu Yin, Shenzhen (CN); Tong Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,730

(22) Filed: Dec. 7, 2019

(65) Prior Publication Data

US 2020/0213692 A1 Jul. 2, 2020

(30) Foreign Application Priority Data

Dec. 28, 2018 (CN) ..... 2018 2 2275512 U

(51) Int. Cl.
*H04R 1/02* (2006.01)
*H04R 9/06* (2006.01)

(52) U.S. Cl.
CPC ..... *H04R 1/023* (2013.01); *H04R 9/06* (2013.01); *H04R 2400/11* (2013.01)

(58) Field of Classification Search
CPC .... H04R 1/023; H04R 1/025; H04R 2499/11; H04R 1/44
See application file for complete search history.

(56) References Cited

U.S. PATENT DOCUMENTS

2009/0245565 A1* 10/2009 Mittleman ..... H04R 1/025 381/365
2012/0134518 A1* 5/2012 Otani ..... H04R 1/023 381/189
2017/0157573 A1* 6/2017 Mori ..... H04R 1/00
2019/0158960 A1* 5/2019 Zhang ..... H04R 9/06
2020/0213693 A1* 7/2020 Yin ..... H04R 1/023

FOREIGN PATENT DOCUMENTS

CN 205320281 B1 6/2016
CN 206136176 B1 4/2017

OTHER PUBLICATIONS

PCT search report dated Jan. 21, 2020 by SIPO in related PCT Patent Application No. PCT/CN2019/113333 (4 Pages).

* cited by examiner

*Primary Examiner* — Mark Fischer
(74) *Attorney, Agent, or Firm* — W&G Law Group LLP

(57) ABSTRACT

The present invention provides a speaker box, including a main body having a plurality of sound holes; and a dustproof mesh adhered to an outer side of the main body for covering the sound hole. The dustproof mesh includes an air-permeable mesh plate covering the sound holes, and a first bonding layer adhered between the air-permeable mesh plate and the main body. The first bonding layer includes a sound transmission holes corresponding to the sound holes and being covered by the air-permeable mesh plate. The speaker box further includes a second bonding layer, including an accommodation hole correspondingly accommodating the air-permeable mesh plate and the first bonding layer. The dustproof mesh has an orthographic projection at the outer side of the main body not overlapping an orthographic projection of the second bonding layer at the outer side of the main body.

14 Claims, 3 Drawing Sheets

SPEAKER BOX AND MOBILE TERMINAL DEVICE USING SAME

FIELD OF THE PRESENT DISCLOSURE

The present invention relates to the electro-acoustic transducers, particularly to a speaker box and a mobile terminal device using the speaker box.

DESCRIPTION OF RELATED ART

In the related art, a speaker box comprises a main body and a dustproof mesh, wherein, the main body is provided with sound holes. The dustproof mesh is adhered to the surface of the main body and covers the sound holes. The dustproof mesh comprises a 0.15 mm-thick first waterproof bonding layer, a 0.05 mm-thick air-permeable mesh plate and a 0.15 mm-thick second waterproof bonding layer which are stacked in order. The dustproof mesh is 0.35 mm thick in total. When the speaker box of the prior art is arranged in a mobile terminal device, a 0.35 mm arranging space in the mobile terminal device needs to be reserved for the dustproof mesh, which is disadvantageous for the small-size design of the mobile terminal device.

Thus, it is necessary to provide an improved speaker box to solve the technical problem above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
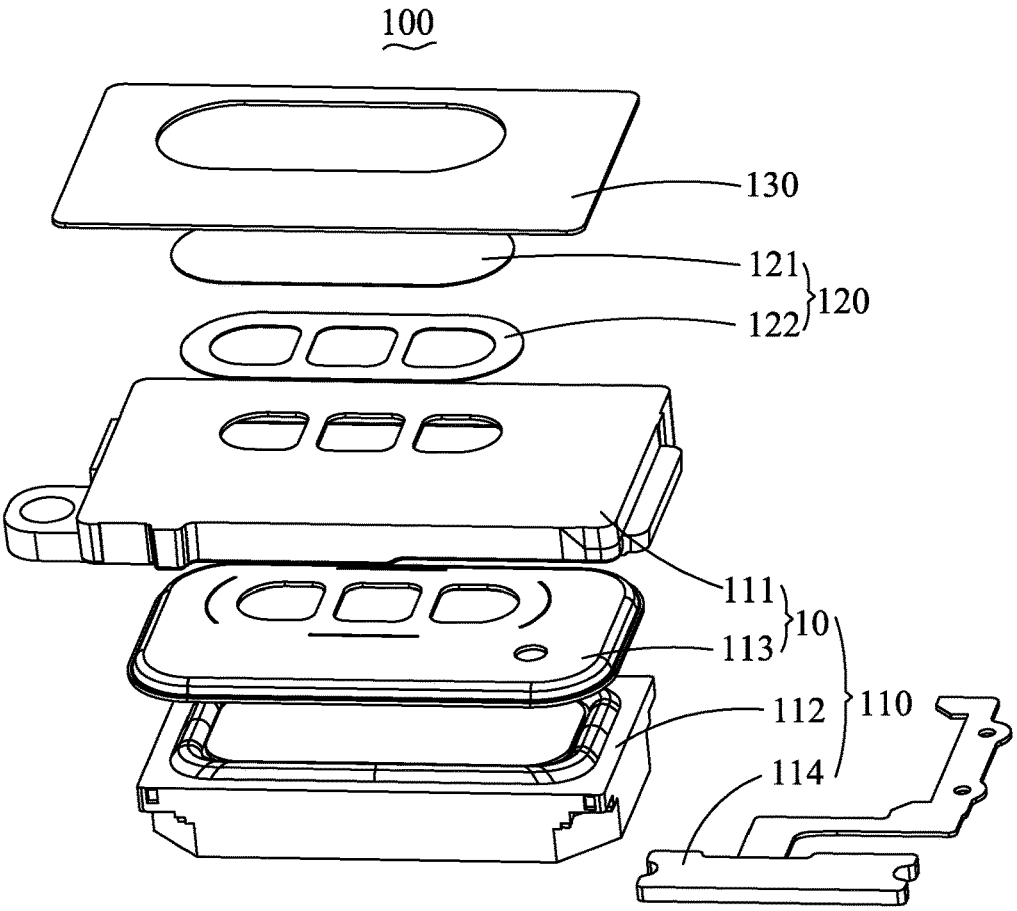
FIG. 1 is an exploded view of a speaker box in accordance with an exemplary embodiment of the present invention.

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Referring to FIGS. 1 and 4-6, an exemplary embodiment of the present invention discloses a speaker box 100. The speaker box 100 comprises a main body 110 and a dustproof mesh 120, wherein, the main body 110 is provided with sound holes 101 for transmitting soundwaves, and the dustproof mesh 120 is adhered to an outer side of the main body 110 and correspondingly covers the sound holes 101.

Specifically, the dustproof mesh 120 comprises an air-permeable mesh plate 121 and a first bonding layer 122. The air-permeable mesh plate 121 covers the sound holes 101. The first bonding layer 122 is bonded between the air-permeable mesh plate 121 and the main body 110. The first bonding layer 122 is provided with sound transmission holes 102 corresponding to the sound holes 101. Specifically, the sound transmission holes 102 penetrates the first bonding layer 122 along a thickness direction of the first bonding layer 122. The air-permeable mesh plate 121 correspondingly covers the sound transmission holes 102. The sound generated by the main body 110 is spread outside through the sound holes 101, the sound transmission holes 102 and the air-permeable mesh plate 121 in order so as to transmit the soundwaves outwardly. The air-permeable mesh plate 121 can prevent dust from entering the sound holes 101. The first bonding layer 122 is used for adhering the air-permeable mesh plate 121 on the main body 110.

Figure 2:
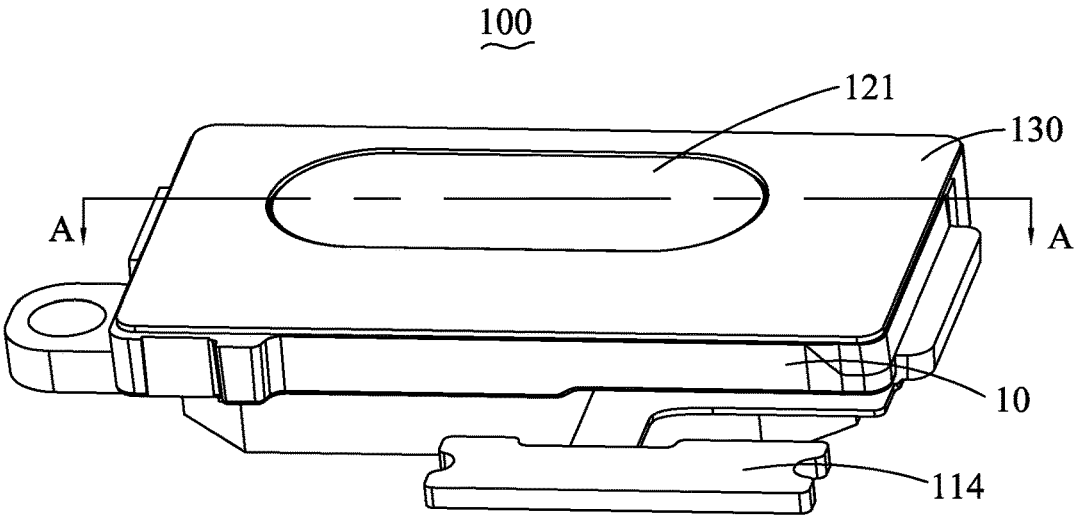
FIG. 2 is an assembled view of the speaker box.
Figure 3:
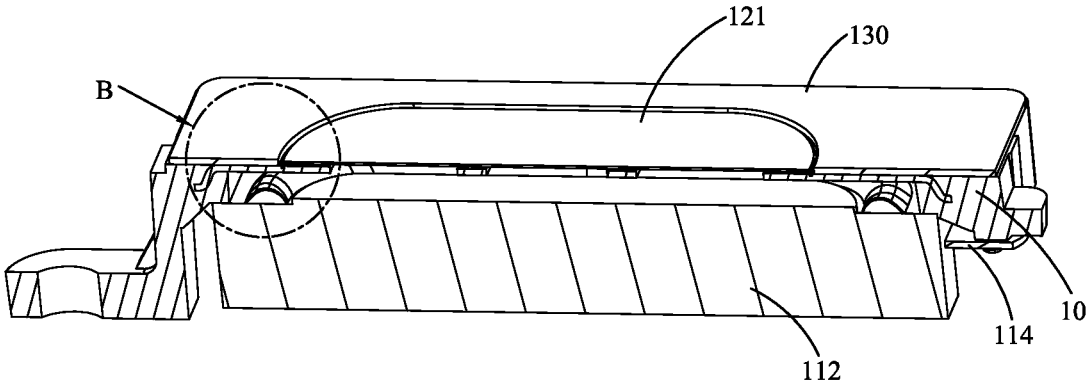
FIG. 3 is a half-cut-off view of the speaker box taken along line A-A in FIG. 2.
Figure 4:
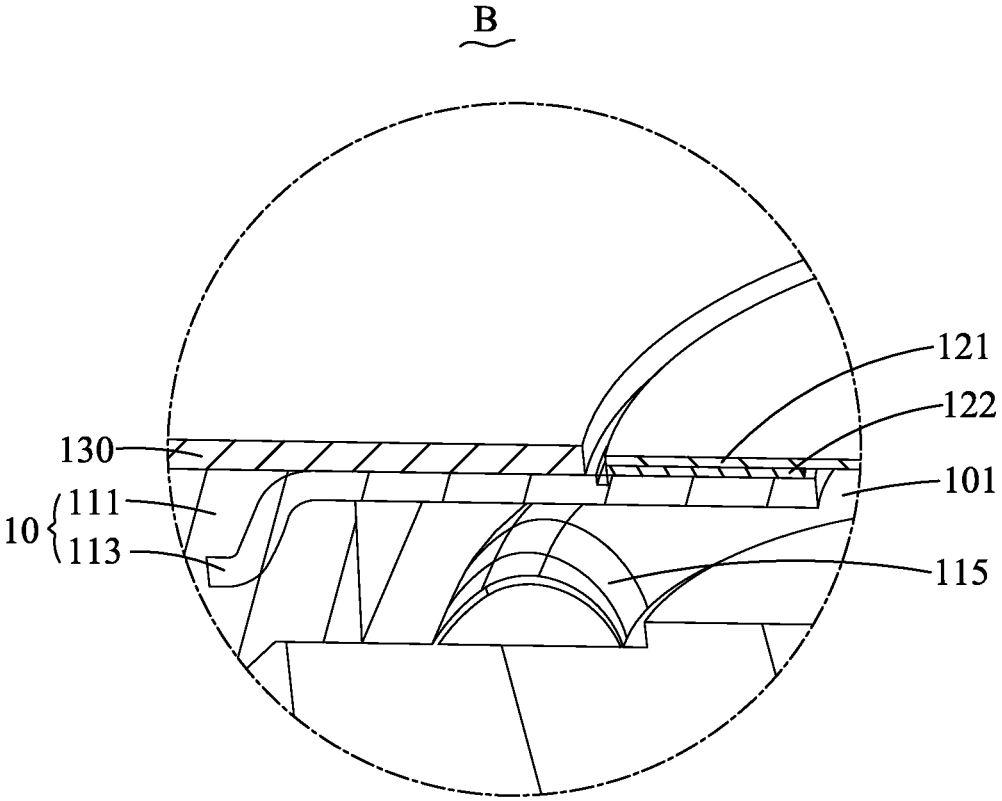
FIG. 4 is an enlarged view of Part B in FIG. 3.
Figure 5:
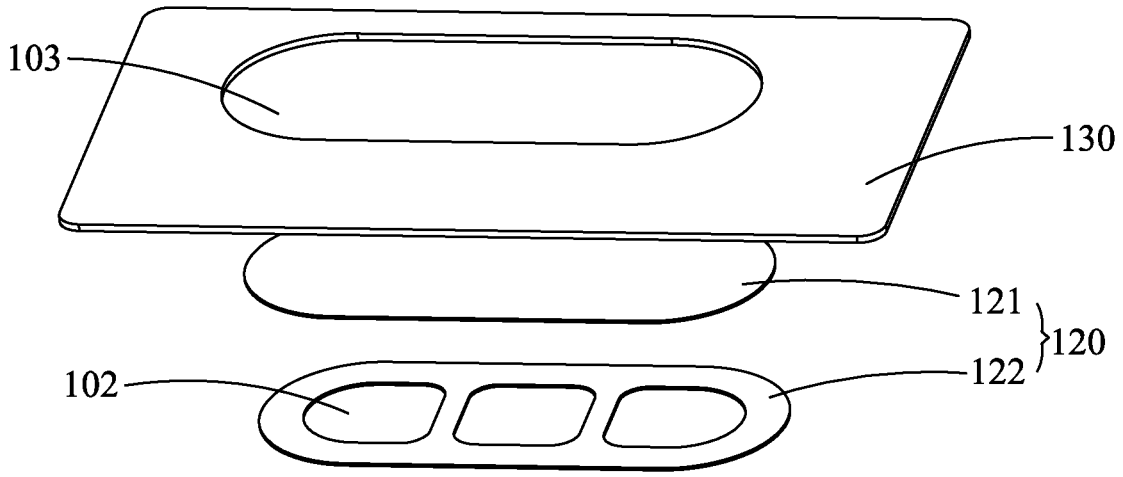
FIG. 5 is an exploded view of dustproof mesh and a second bonding layer used in the speaker box of the exemplary embodiment.

Referring to FIGS. 2-4, the speaker box 100 further comprises a second bonding layer 130 adhered to the outer side of the main body 110. The second bonding layer 130 is a ring-shaped component. An accommodation hole 103 correspondingly accommodating the air-permeable mesh plate 121 and the first bonding layer 122 penetrates the middle part of the second bonding layer 130. The accommodation hole 103 is the inner ring hole of the second bonding layer 130. An orthographic projection of the dustproof mesh 120 at the outer side of the main body 110 and the orthographic projection of the second bonding layer 130 at the outer side of the main body 110 don't mutually overlap. The air-permeable mesh plate 121 and the first bonding layer 122 are overlapped and cover the sound holes 101, and form the inner ring part of the dustproof mesh 120. The inner ring part is mainly used for dustproof function. The second bonding layer 130 surrounds the periphery of the air-permeable mesh plate 121 and the loudspeaker main body and is adhered to the loudspeaker main body to form the outer ring part of the dustproof mesh 120. The outer ring part is mainly used for waterproof function.

Preferably, in the embodiment, the sound holes 101 comprise three first holes arranged with intervals, and the sound transmission holes 102 correspondingly comprise three second holes counterpointed with the three first holes. Of course, the arrangement of the sound holes 101 and the hole positions on the first bonding layer 122 is not limited by above in specific application.

Preferably, the peripheral contour shape and the peripheral contour size of the first bonding layer 122 are same as the peripheral contour shape and the peripheral contour size of the air-permeable mesh plate 121.

Preferably, the air-permeable mesh plate 121 is 0.05 mm±0.01 mm thick. The air-permeable mesh plate 121 which is 0.05 mm±0.01 mm thick has high universality in the speaker box 100 and is convenient for mass production.

Preferably, in the embodiment, the first bonding layer 122 is made of a common double-sided adhesive tape and 0.05 mm±0.01 mm thick. The first bonding layer 122 and the air-permeable mesh plate 121 are overlapped to cover the sound holes 101, which can meet the dustproof design requirement of the sound holes 101. Of course, in specific application, as an alternative embodiment, the first bonding layer 122 can also be formed by coating glue on the air-permeable mesh plate 121 (after the glue is solidified).

Preferably, the second bonding layer 130 is made of a waterproof double-sided adhesive tape and is 0.15 mm±0.02 mm thick. The second bonding layer 130 of the same thickness surrounds the periphery of the air-permeable mesh plate 121 and the first bonding layer 122, and can meet the waterproof design requirement of the dustproof mesh 120.

Of course, in specific application, the second bonding layer 130 can also be formed by coating glue (after the glue is solidified).

As a good example of the embodiment, the air-permeable mesh plate 121 is 0.05 m thick, the first bonding layer 122 is 0.05 mm thick, and the second bonding layer 130 is 0.15 mm thick, and therefore, the air-permeable mesh plate 121, the first bonding layer 122 and the second bonding layer 130 are convenient to be manufactured and shaped.

In the embodiment, the sum of the thickness of the air-permeable mesh plate 121 and the thickness of the first bonding layer 122 is smaller than the thickness of the second bonding layer 130, and the total thickness of the dustproof mesh 120 is the same thickness of the second bonding layer 130. When installed, the space for arranging the air-permeable mesh plate 121 and the first bonding layer 122 is saved (the arranging space of 0.2 mm is saved in the embodiment).

Of course, in specific application, as an alternative of the embodiment, the sum of the thickness of the air-permeable mesh plate 121 and the thickness of the first bonding layer 122 is set as the thickness of the second bonding layer 130 (for example, the thickness of the first bonding layer 122 is set as 0.1 mm, the thickness of the air-permeable mesh plate 121 is set as 0.05 mm, and the thickness of the second bonding layer 130 is set as 0.15 mm). When installed, the space for arranging the air-permeable mesh plate 121 and the first bonding layer 122 can also be saved.

As another alternative of the embodiment, the sum of the thickness of the air-permeable mesh plate 121 and the thickness of the first bonding layer 122 can be set as greater than the thickness of the second bonding layer 130 (for example, the thickness of the first bonding layer 122 is set as 0.15 mm, the thickness of the air-permeable mesh plate 121 is set as 0.05 mm, and the thickness of the second bonding layer 130 is set as 0.15 mm). When installed, the space for arranging the second bonding layer 130 can be saved.

Figure 6:
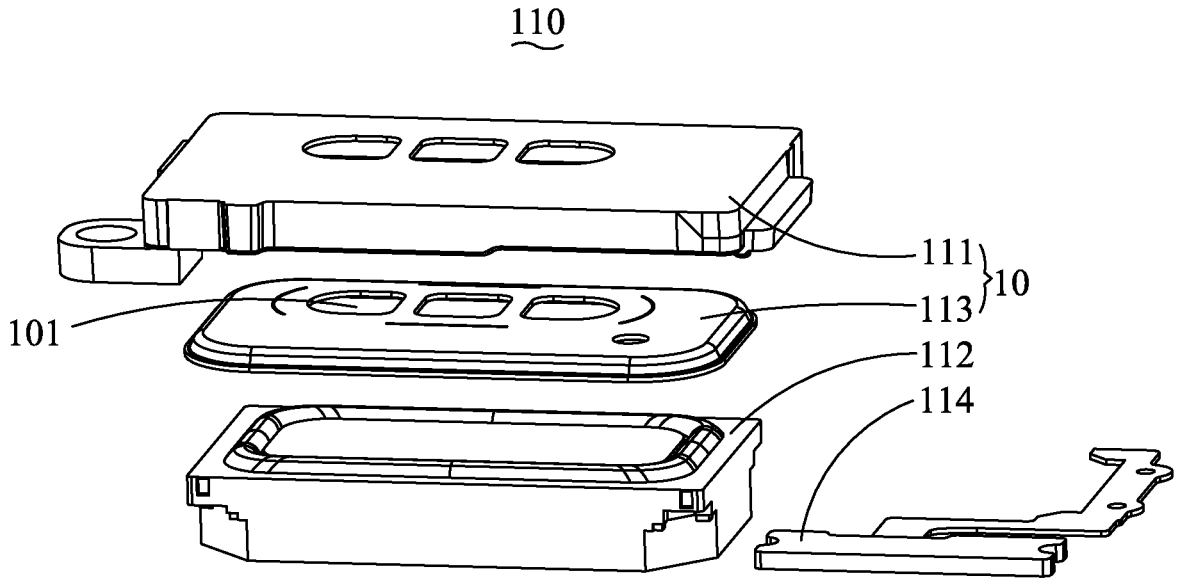
FIG. 6 is an exploded view of a main body of the speaker box.

Specifically, please refer to FIGS. 3-4 and 6, the main body 110 comprises a housing 10, a speaker unit 112 and a flexible circuit board 114 (FPC). The sound holes 101 are arranged on the housing 10, and the speaker unit 112 is fixed on the housing 10 and corresponds to the sound holes 101. The speaker unit 112 and the dustproof mesh 120 are respectively arranged at the two opposite sides of the housing 10. The flexible circuit board 114 is arranged at one side of the speaker unit 112.

Preferably, please refer to FIGS. 3-4, the housing 10 comprises a plastic support 111 and a metal sheet body 113, wherein, the metal sheet body 113 is embedded in the plastic support 111. The plastic support 111 and the metal sheet body 113 are molded in one body. The speaker unit 112 is provided with a vibrating diaphragm 115. The metal sheet body 113 and the vibrating diaphragm 115 are opposite. The sound holes 101 correspondingly penetrate the metal sheet body 113.

Specifically, the main body 110 further comprises a cover plate (not shown). The housing 10 covers the cover plate and encloses with the cover plate to form an accommodation chamber. The speaker unit 112 is arranged in the accommodation chamber. The speaker unit 112 and the cover plate together enclose to form a front chamber. The speaker unit 112, the metal sheet body 113 and the plastic support 111 together enclose to form a back chamber. The front chamber is used for sounding, and the back chamber is used for improving the low frequency acoustic performance of the speaker box 100. The arrangement of the metal sheet body 113 both enhances the strength of the housing 10 as a support, and decreases the thickness of the housing 10, which is helpful for getting a larger back chamber and then for improving the bass effect of the main body 110. Besides, the above is also helpful for improving the heat radiation effect of the speaker box 100.

Further, the embodiment of the present invention provides a mobile terminal device which comprises a shell (not shown) and the speaker box 100. The speaker box 100 is arranged in the shell. The speaker box 100 is adhered and fixed to the shell through the second bonding layer 130. The mobile terminal device provided by the embodiment adopts the speaker box 100 above and therefore the space reserved for arranging the speaker box 100 in the housing is reduced, which is helpful for designing a smaller mobile terminal device.

Preferably, the mobile terminal device can be a mobile phone, a tablet PC, an mp3 player, an mp4 player or an mp5 player. The mobile terminal devices adopting the structural design scheme of the speaker box 100 of the embodiment can be designed smaller.

In the embodiment, the dustproof mesh 120 is separated into two parts. The inner ring comprises a 0.05 mm mesh (the air-permeable mesh plate 121) and a 0.05 mm common double-sided adhesive tape (the first bonding layer 122) which are overlapped to meet the dustproof requirement of the sound holes 101. The outer ring is adhered with a 0.15 mm ring-shaped double-sided adhesive tape (the second bonding layer 130) to ensure stable waterproof function. The inner ring is 0.1 mm thick and thinner than the 0.15 mm waterproof double-sided adhesive tape, and therefore the height space is not influenced. Thus, the outer side height of the sound holes 101 only needs the arranging space of 0.15 mm, which reduces the arranging space of the dustproof mesh 120.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, including:

a main body having a plurality of sound holes;

a dustproof mesh, adhered to an outer side of the main body for covering the sound holes, including an air-permeable mesh plate covering the sound holes, and a first bonding layer adhered between the air-permeable mesh plate and the main body, wherein, the first bonding layer including sound transmission holes corresponding to the sound holes and being covered by the air-permeable mesh plate;

a second bonding layer, adhered to the outer side of the main body, including an accommodation hole correspondingly accommodating the air-permeable mesh plate and the first bonding layer, with the second bonding layer located around and spaced apart from both the dustproof mesh and the first bonding layer, wherein the dustproof mesh has an orthographic projection at the outer side of the main body not overlapping an orthographic projection of the second bonding layer at the outer side of the main body.

2. The speaker box according to claim 1, wherein a sum of a thickness of the air-permeable mesh plate and a thickness of the first bonding layer is smaller than or equal to a thickness of the second bonding layer.

3. The speaker box according to claim 2, wherein the second bonding layer has thickness of 0.15 mm±0.02 mm.

4. The speaker box according to claim 3, wherein the air-permeable mesh plate has a thickness of 0.05 mm±0.01 mm, and the first bonding layer has a thickness of 0.05 mm±0.01 mm.

5. The speaker box according to claim 2, wherein a peripheral contour shape of the first bonding layer is same as a peripheral contour shape of the air-permeable mesh plate.

6. The speaker box according to claim 2, wherein the first bonding layer is made of a double-sided adhesive tape; and/or, the second bonding layer is made of a waterproof double-sided adhesive tape.

7. The speaker box according to claim 2, wherein the main body comprises a housing and a speaker unit fixed to the housing, the housing is provided with the sound holes; the speaker unit and the dustproof mesh are respectively arranged at the two opposite sides of the housing.

8. The speaker box according to claim 7, wherein the housing comprises a plastic support and a metal sheet body embedded in the plastic support; the speaker unit includes a vibrating diaphragm opposite to the metal sheet body, and the sound holes correspondingly penetrate the metal sheet body.

9. The speaker box according to claim 1, wherein a peripheral contour shape of the first bonding layer is same as a peripheral contour shape of the air-permeable mesh plate.

10. The speaker box according to claim 1, wherein the first bonding layer is made of a double-sided adhesive tape; and/or, the second bonding layer is made of a waterproof double-sided adhesive tape.

11. The speaker box according to claim 1, wherein the main body comprises a housing and a speaker unit fixed to the housing, the housing is provided with the sound holes; the speaker unit and the dustproof mesh are respectively arranged at the two opposite sides of the housing.

12. The speaker box according to claim 11, wherein the housing comprises a plastic support and a metal sheet body embedded in the plastic support; the speaker unit includes a vibrating diaphragm opposite to the metal sheet body, and the sound holes correspondingly penetrate the metal sheet body.

13. A mobile terminal device comprising a shell and a speaker box as described in claim 1, wherein the speaker box is adhered and fixed to the shell through the second bonding layer.

14. The mobile terminal device according to claim 13, wherein the mobile terminal device is a mobile phone, a tablet PC, an mp3 player, an mp4 player or an mp5 player.

* * * * *